US006136508A

United States Patent [19]

DeBoer et al.

[11] Patent Number: 6,136,508

[45] **Date of Patent: *Oct. 24, 2000**

[54] LITHOGRAPHIC PRINTING PLATES WITH A SOL-GEL LAYER

[75] Inventors: Charles D. DeBoer, Palmyra; Judith L. Fliessig, Rochester, both of N.Y.

[73] Assignee: Kodak Polychrome Graphics LLC, Norwalk, Conn.

[ * ] Notice: This patent is subject to a terminal disclaimer.

[21] Appl. No.: 09/145,164

[22] Filed: Sep. 2, 1998

Related U.S. Application Data

[63] Continuation-in-part of application No. 08/997,958, Dec. 24, 1997, abandoned, which is a continuation-in-part of application No. 08/979,916, Mar. 13, 1997, abandoned.

[51] Int. Cl.[7] ..... B41C 1/055; B41M 5/40

[52] U.S. Cl. ..... 430/302; 430/945; 430/201; 430/200; 430/300; 430/272.1; 101/467; 101/457

[58] Field of Search ..... 430/302, 300, 430/301, 200, 201, 945, 272.1; 101/457, 467

[56] References Cited

U.S. PATENT DOCUMENTS

| | | | |
|---|---|---|---|
| 2,244,325 | 6/1941 | Bird | 252/313 |
| 2,574,902 | 11/1951 | Bechtold et al. | 252/313 |
| 2,597,872 | 5/1952 | Iler | 260/29.6 |
| 3,476,937 | 11/1969 | Vrancken | 101/470 |
| 3,832,948 | 9/1974 | Barker | 101/401.1 |
| 3,964,389 | 6/1976 | Peterson | 101/467 |
| 3,964,906 | 6/1976 | Kenney | 101/465 |
| 4,034,183 | 7/1977 | Uhlig | 219/121.85 |
| 4,054,094 | 10/1977 | Caddell et al. | 101/467 |
| 4,081,572 | 3/1978 | Pacansky | 101/467 |
| 4,308,799 | 1/1982 | Kitagawa et al. | 101/467 |
| 4,470,797 | 9/1984 | Harry et al. | 425/534 |
| 4,695,286 | 9/1987 | Vanier et al. | 8/471 |
| 4,731,317 | 3/1988 | Fromson et al. | 430/159 |
| 4,742,092 | 5/1988 | Inoue et al. | 522/27 |
| 4,775,657 | 10/1988 | Harrison et al. | 503/227 |
| 4,912,084 | 3/1990 | Kanto et al. | 503/227 |
| 4,962,081 | 10/1990 | Harrison et al. | 503/227 |
| 4,973,572 | 11/1990 | DeBoer | 503/227 |
| 5,024,990 | 6/1991 | Chapman et al. | 430/201 |
| 5,372,907 | 12/1994 | Haley et al. | 430/302 |
| 5,387,496 | 2/1995 | DeBoer | 430/201 |
| 5,446,477 | 8/1995 | Baek et al. | 346/138 |
| 5,451,485 | 9/1995 | Kaszczuk et al. | 430/201 |
| 5,458,591 | 10/1995 | Roessler et al. | 604/364 |
| 5,460,918 | 10/1995 | Ali et al. | 101/453 |
| 5,491,046 | 2/1996 | DeBoer et al. | 430/302 |
| 5,569,573 | 10/1996 | Takahashi et al. | 430/138 |
| 5,574,493 | 11/1996 | Sanger et al. | 347/262 |
| 5,639,586 | 6/1997 | Hauquier et al. | 430/159 |
| 5,804,531 | 9/1998 | Evans et al. | 503/227 |
| 5,816,162 | 10/1998 | Vermeersch | 101/467 |
| 5,985,515 | 11/1999 | Van Rompuy et al. | 430/302 |
| 6,014,930 | 1/2000 | Buberry et al. | 430/302 |

FOREIGN PATENT DOCUMENTS

| | | |
|---|---|---|
| 0562952A1 | 3/1993 | European Pat. Off. . |
| 0 573 091 A1 | 12/1993 | European Pat. Off. . |
| 0 573 092 A1 | 12/1993 | European Pat. Off. . |
| 0 683 728 B1 | 11/1995 | European Pat. Off. . |
| 0698503 | 2/1996 | European Pat. Off. . |
| 44 42 235 | 6/1995 | Germany . |
| 55/105560 | 8/1980 | Japan . |
| 92/09934 | 6/1992 | WIPO . |
| 94/18005 | 8/1994 | WIPO . |

*Primary Examiner*—Martin Angebranndt
*Attorney, Agent, or Firm*—Ratner & Prestia

[57] ABSTRACT

A precursor element for making a lithographic printing plate is composed of a support, an ink receptive thermal conversion inner layer and a sol-gel, ink repellent outer layer. The outer sol-gel layer containes crosslinked colloids derived from certain metal oxides or hydroxides. The plates produced from the ellements are long-running plates that require no post-imaging processing.

32 Claims, No Drawings

LITHOGRAPHIC PRINTING PLATES WITH A SOL-GEL LAYER

RELATED APPLICATIONS

This application is a continuation-in-part of U.S. Ser. No. 08/997,958 filed Dec. 24, 1997 now abandoned, which is a continuation-in-part of U.S. Ser. No. 08/979,916 filed Mar. 13, 1997 now abandoned, by DeBoer and Fleissig, and entitled, "LITHOGRAPHIC PRINTING PLATES WITH A SOL-GEL LAYER". This application is related to U.S. Ser. No. 08/816,287 filed on Mar. 13, 1997, by DeBoer and Fleissig, and entitled, "METHOD OF IMAGING LITHOGRAPHIC PRINTING PLATES WITH HIGH INTENSITY LASER".

FIELD OF THIS INVENTION

This invention relates in general to lithographic printing plates and particularly to lithographic printing plates which do not require wet processing.

BACKGROUND OF THE INVENTION

The art of lithographic printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced; such as paper, cloth and the like. Commonly the ink is transferred to an intermediate material called the blanket which in turn transfers the ink to the surface of the material upon which the image is to be reproduced.

A very widely used type of lithographic printing plate has a light-sensitive coating applied to an aluminum base support The coating may respond to light by having the portion which is exposed become soluble so that it is removed in the developing process. Such a plate is referred to as positive-working. Conversely, when that portion of the coating which is exposed becomes hardened, the plate is referred to as negative-working. In both instances the image area remaining is ink-receptive or oleophilic and the non-image area or background is water-receptive or hydrophilic. The differentiation between image and non-image areas is made in the exposure process where a film is applied to the plate with a vacuum to insure good contact. The plate is then exposed to a light source, a portion of which is composed of UV radiation. In the instance where a positive plate is used, the area on the film that corresponds to the image on the plate is opaque so that no light will strike the plate, whereas the area on the film that corresponds to the non-image area is clear and permits the transmission of light to the coating which then becomes more soluble and is removed. In the case of a negative plate the converse is true. The area on the film corresponding to the image area is clear while the non-image area is opaque. The coating under the clear area of film is hardened by the action of light while the area not struck by light is removed. The light-hardened surface of a negative plate is therefore oleophilic and will accept ink while the non-image area which has had the coating removed through the action of a developer is desensitized and is therefore hydrophilic.

Direct write photothermal litho plates are known as the Kodak Direct Image Thermal Printing Plate. However, they require wet processing in alkaline solutions. It would be desirable to have a (direct write photothermal litho plate that did not require any processing.

The prior art has tried to produce such plates by a variety of means. All of them fall short of a plate that has high writing sensitivity, high image quality, short roll up, and long run length without any processing.

U.S. Pat. No. 5,372,907 describes a direct write litho plate which is exposed to the laser beam, then heated to crosslink and thereby prevent the development of the exposed areas and to simultaneously render the unexposed areas more developable, and the plate is then developed in conventional alkaline plate developer solution. The problem with this is that developer solutions and the equipment that contains them require maintenance, cleaning, and periodic developer replenishment, all of which are costly and cumbersome.

U.S. Pat. No. 4,034,183 describes a direct write litho plate without development whereby a laser absorbing hydrophilic top layer coated on a support is exposed to a laser beam to burn the absorber to convert it from an ink repelling to an ink receiving state. All of the examples and teachings require a high power laser, and the run lengths of the resulting litho plates are limited.

U.S. Pat. No. 3,832,948 describes both a printing plate with a hydrophilic layer that may be ablated by strong light from a hydrophobic support and also a printing plate with a hydrophobic layer that may be ablated from a hydrophilic support. However, no examples are given.

U.S. Pat. No. 3,964,389 describes a no process printing plate made by laser transfer of material from a carrier film (donor) to a lithographic surface. The problem of this method is that small particles of dust trapped between the two layers may cause image degradation. Also, the necessity of preparing two sheets is more expensive.

U.S. Pat. No. 4,054,094 describes a process for making a litho plate by using a laser beam to etch away a thin top coating of polysilicic acid on a polyester base, thereby rendering the exposed areas receptive to ink. No details of run length or print quality are given, but it is expected that an uncrosslinked polymer such as polysilicic acid will wear off relatively rapidly and give a short run length of acceptable prints.

U.S. Pat. No. 4,081,572 describes a method for preparing a printing master on a substrate by coating the substrate with a hydrophilic polyamic acid and then imagewise converting the polyamic acid to melanophilic polyimide with heat from a flash lamp or a laser. No details of run length, image quality or ink/water balance are given.

U.S. Pat. No. 4,731,317 describes a method for making a litho plate by coating a polymeric diazo resin on a grained anodized aluminum litho support, exposing the image areas with a YAG laser, and then processing the plate with a graphic arts lacquer. The lacquering step is inconvenient and expensive.

Japanese Kokai No. 55/105560 describes a method of preparation of a litho plate by laser beam removal of a hydrophilic layer coated on a melanophilic support, in which the hydrophilic layer contains colloidal silica, colloidal alumina, a carboxylic acid, or a salt of a carboxylic acid. The only examples given use colloidal alumina alone, or zinc acetate alone, with no crosslinkers or addenda. No details are given for the ink/water balance or limiting run length.

WO 92/09934 describes and broadly claims any photosensitive composition containing a photoacid generator and a polymer with acid labile tetrahydropyranyl groups. This would include a hydrophobic/hydrophilic switching lithographic plate composition. However, such a polymeric switch is known to give weak discrimination between ink and water in the printing process.

EP 0 562 952 A1 describes a printing plate having a polymeric azide coated on a lithographic support, and removal of the polymeric azide by exposure to a laser beam. No printing press examples are given.

WO 94/18005 describes a printing plate having a laser absorbing layer coated on a support with a crosslinked hydrophilic layer which is removed upon exposure to the laser. All the examples teach a polyvinyl alcohol layer crosslinked with hydrolyzed tetraethylorthosilicate.

U.S. Pat. No. 5,460,918 describes a thermal transfer process for preparing a litho plate from a donor with an oxazoline polymer to a silicate surface receiver. A two sheet system such as this is subject to image quality problems from dust and the expense of preparing two sheets.

It would be desirable to be able to prepare a litho plate that has high writing sensitivity, high image quality, short roll up, and long run length without any processing. None of the prior art examples can do this satisfactorily.

SUMMARY OF THE INVENTION

The present invention is a lithographic printing plate in which a support web is coated with an ink accepting laser absorbing layer which is subsequently overcoated with a crosslinked hydrophilic layer having metal oxide groups on the surface. Exposure of this plate to a high intensity laser beam followed by mounting on a press results in excellent impressions without chemical processing.

The lithographic printing plate precursor element comprises:

a) a support web with b) a coextensive melanophilic, i.e., ink receptive, photothermal conversion layer with c) a coextensive melanophobic, i.e., ink repellent, layer comprising a crosslinked polymeric matrix containing a colloid of an oxide or a hydroxide of a metal selected from the group consisting of beryllium, magnesium, aluminum, silicon, gadolinium, germanium, arsenic, indium, tin, antimony, tellurium, lead, bismuth, a transition metal and combinations thereof.

DETAILED DESCRIPTION OF THE INVENTION

The support for this invention can be a polymer, metal or paper foil, or a lamination of any of the three. The thickness of the support can be varied, as long as it is sufficient to sustain the wear of the printing press and thin enough to wrap around the printing form. A preferred embodiment use, polyethylene terephthalate in a thickness from 100 to 200 microns. Another preferred embodiment uses aluminum from 100 to 500 microns in thickness. The support should resist stretching so the color printing records will register in a full color image. The support may be coated with one or more "subbing" layers to improve adhesion of the final assemblage. The back side of the support may be coated with antistat agents and/or slipping layers or matte layers to improve handling and "feel" of the litho plate.

The term "melanophilic" is Greek for ink-loving, i.e., "ink receptive", and the term melanophobic is Greek for ink-fearing, i.e., "ink repellent". Since most conventional printing inks are linseed oil based and are used with an aqueous fountain solution in conventional lithographic printing, melanophilic will usually coincide with "oleophilic" and melanophobic will usually coincide with "hydrophilic".

The photothermal conversion layer absorbs laser radiation and converts it into heat. It converts photons into phonons. To do this it must contain a non-luminescent, radiation absorber. Such an absorber may be a dye, a pigment, a metal, or a dichroic stack of materials that absorb by virtue of their refractive index and thickness. The absorber may be in the hydrophilic layer or thermally close to the hydrophilic layer. By this it is implied that a significant portion of the heat generated by the absorber acts to raise the temperature of the hydrophilic layer to a level where switching to the melanophilic state occurs. Examples of dyes useful as absorbers for near infrared diode laser beams may be found in U.S. Pat. No. 4,973,572, hereby incorporated by reference. Preferred infrared (IR) absorbing dyes for use in this invention are 2-{2-{2-Chloro-3-{(1,3-dihydro-1,1,3-trimethyl-2H-benz{e}indol-2-ylidene)ethylidene}-1-cyclohexen-1yl}-ethenyl}-1,1,3-trimethyl-1H-benz{e}indolium salt of 4-methylbenzenesufonate; and 2-{2-{2-chloro-3-{(1,3-dihydro-1,1-dimethyl-3-sulfonatopropyl-2H-benz{e}indol-2-ylidene)ethylidene}-1-cylcohexen-1-yl}ethenyl}-1,1-dimethyl-3-sulfonatopropyl-1H-benz{e}indolium sodium salt. In a preferred embodiment of the invention the absorber is a pigment. In a more preferred embodiment of the invention the pigment is carbon, particularly sulfonic acid surface modified submicron carbon particles. The size of the particles should not be more than the thickness of the layer. Preferably, the size of the particles will be half the thickness of the layer or less, from about 0.1 micron to about 0.5 micron.

The binder used to hold the dye or pigment in the photothermal conversion layer may be chosen from a large list of film forming polymers. Useful polymers may be found in the families of polycarbonates, polyesters, polyvinylbutyrals and polyacrylates. Chemically modified cellulose derivatives are particularly useful, such as nitrocellulose, cellulose acetate propionate, and cellulose acetate. Exemplary polymers may be found in U.S. Pat. Nos 4,695,286; 4,470,797; 4,775,657; and 4,962,081, hereby incorporated by reference. Preferred photothermal conversion layers of this type includes layers comprising carbon dispersed in a cellulosic binder, and particularly layers comprising carbon dispersed in nitrocelulose. A particularly advantageous polymer for dispersing carbon is a polyvinylbutyral such as Butvar B76 poly(vinylbutyral-co-vinylalcohol-co-vinylacetate)(80%, 18%,2%) from Monsant,).

Surfactants may be included in the photothermal conversion layer to facilitate coating uniformity. A particularly useful surfactant for coated polymer layers is DC510, a silicone oil sold by the Dow Corning Company of Midland, Mich.

The melanophobic or hydrophillic layer is intended to be wet effectively by the aqueous fountain solution in the lithographic printing process, and when wet, to repel the ink. In addition it is useful if the hydrophlic layer is somewhat porous, so that wetting is even more effective. The hydrophillic layer must be crosslinked if long printing run lengths are to be achieved, because an uncrosslinked layer will wear away too quickly. The ink repellent or hydrophilic layer is a sol-gel layer which is a crosslinked polymeric matrix containing a colloid of an oxide or a hydroxide of a metal selected from the group consisting of beryllium, magnesium, aluminum, silicon, gadolinium, germanium, arsenic, indium, tin, antimony, tellurium, lead, bismuth, a transition metal and combinations thereof. Many such crosslinked hydrophilic layers are available. Those derived from di, tri, or tetra alkoxy silanes or titanates, zirconates and aluminates are particularly useful in this invention. Examples are colloids of hydroxysilicon, hydroxyaluminum, hydroxytitanium and hydroxyzirconium. These colloids are formed by methods fully described in U.S. Pat. Nos. 2,244,325; 2,574,902; and 2,597,872. Stable dispersions of such colloids can be conveniently purchased from companies such as the DuPont Company of Wilmington, Del. The hydrophilic layer is most effective when it contains a minimum amount of hydrophobic groups such as methyl or alkyl groups. The hydrophilic layer preferably should contain less than 5% hydrocarbon groups by weight. A preferred embodiment of the invention uses 3-aminopropyl-triethoxysilane as the crosslinking and polymer forming layer, with the addition of colloidal silica to add porosity to the layer. The thickness of the crosslinking and polymer forming layer may be from 0.05 to 1 $\mu$m in thickness, and most preferably from 0.1 to 0.3 $\mu$m in thickness. The amount of silica added to the layer may be from 100 to 5000% of the crosslinking agent, and most preferably from 500% to 1500% of the crosslinking agent. Surfactants, dyes, colorants useful in visualizing the written image, and other addenda may be added to the hydrophilic layer, as long as their level is low enough that there is no significant interference with the ability of the layer to hold water and repel ink.

The layers are coated onto the support by any of the commonly known coating methods such as spin coating, knife coating, gravure coating, dip coating, or extrusion hopper coating.

The process for using the resulting lithographic plate comprises the steps of 1) exposing the plate to a focused laser beam in the areas where ink is desired in the printing image, and 2) employing the plate on a printing press. The laser used to expose the lithoplate of this invention is preferably a diode laser, because of the reliability and low maintenance of diode laser systems, but other lasers such as gas or solid state lasers may also be used. After exposure, no heating processing, or cleaning is needed before the printing operation. A vacuum cleaning dust collector may be useful during the laser exposure step to keep the focusing lens clean. Such a collector is fully described in U.S. Pat. No. 5,574,493. The power, intensity and exposure level of the laser is fully described in the above cross referenced co-pending application.

The printing plate of this invention is illustrated by the following examples but is not intended to be limited thereby.

EXAMPLE 1

A mixture of 10 g of carbon ((cabot Black Pearls 700) in 400 g methyl ethyl ketone and 400 g methylisobutyl ketone with 21 g of nitrocellulose was tumbled with 1 mm diameter zirconium oxide beads (the amount of beads filled half the container) for 24 hours. The beads were filtered off and the suspension was coated onto polyethylene terephthalate at 32 cc/m$^2$ wet laydown. When dry, the web was overcoated with a solution of 120 g of colloidal silica stabilized with ammonia (Nalco 2326, 5 nm colloidal silica, ammonia stabilized, from the Nalco Corporation, Naperville, Ill.) mixed with 280 g of water, 2 g of 3-aminopropyltriethoxysilane and 0.1 g of Zonyl FSN surfactant (DuPont Corporation, Wilmington, Del.), the mixture coated at 16 cc per square meter wet laydown. The coating was dried for 3 minutes at 118° C. The coating was then exposed to a focused diode laser beam at 830 nm wavelength on an apparatus similar to that described in U.S. Pat. No. 5,446,477. The exposure level was about 600 mJ/cm$^2$, and the intensity of the beam was about 3 mW/$\mu^2$. The laser beam was modulated to produce a halftone dot image. After exposure the plate was mounted on an ABDick press and several thousand good impressions were made.

EXAMPLE 2

A mixture of tetrabutyltitanate in propanol was stirred with slow addition of a total of 5% water, added as 10% water in propanol. The tetrabutyltitanate amount was chosen so the total concentration was 0.5% after addition of the water in propanol. After 2 hours the mixture had a slightly hazy appearance. The mix was then coated at 21.5 cc/m$^2$ on the carbon-nitrocellulose coated support of Example 1 and dried at 118° C. for 3 minutes. The coating was then exposed to a focused diode laser beam at 830 nm wavelength on an apparatus similar to that described in U.S. Pat. No. 5,446,477. The exposure level was about 600 mJ/cm$^2$, and the intensity of the beam was about 3 mW/$\mu^2$. The laser beam was modulated to produce a halftone dot image. After exposure the plate was mounted on an ABDick press and several adequate impressions were made.

EXAMPLE 3

A mixture of 5% colloidal alumina (Dispal 18N4-20) with 0.5% hydrolyzed tetraethylorthosilicate (prepared by stirring together for 10 minutes 22 g tetraethylorthosilicate, 44 g water and 44 g ethanol with 300 mg concentrated hydrochloric acid) and 0.5% zonyl FSN surfactant in water was coated at 21.5 cc/m$^2$ onto the carbon-nitrocellulose coated support of Example 1 and dried at 118° C. for 3 minutes. The coating was then held at 100° C. for 1 hour. The coating was then exposed to a focused diode laser beam at 830 nm wavelength on an apparatus similar to that described in U.S. Pat. No. 5,446,477. The exposure level was about 600 mJ/cm$^2$, and the intensity of the beam was about 3 mW/$\mu^2$. The laser beam was modulated to produce a halftone dot image. After exposure the plate was mounted on an ABDick press and several thousand good impressions were made.

EXAMPLE 4

A mixture of 22 g of tetraethylorthosilicate, 44 g water and 44 g ethanol with 300 mg concentrated hydrochloric acid was diluted with 4.4 liters of water and 0.5% Zonyl FSN surfactant in water was added. The mixture was coated at 21.5 cc/m$^2$ on the carbon-nitrocellulose coated support of Example 1 and dried at 118° C. for 3 minutes. The coating was then held at 100° C. for 1 hour. The coating was then exposed to a focused diode laser beam at 830 nm wavelength on an apparatus similar to that described in U.S. Pat. No. 5,446,477. The exposure level was about 600 mJ/cm$^2$, and the intensity of the beam was about 3 mW/$\mu^2$. The laser bean was modulated to produce a halftone dot image. After exposure the plate was mounted on an ABDick press and several good impressions were made.

EXAMPLE 5

A solution of 4 g of nitrocellulose and 2 g of 2-{2-{2-Chloro-3-{(1,3-dihydro-1,1,3-trimethyl-2H-benz{e}indol-2-ylidene)ethylidene}-1-cyclohexen-1-yl }-ethenyl}-1,1,3-trimethyl-1H-benz{e}indolium salt of 4-methylbenzenesufonate in 200 cc of a 70:30 mixture of methylisobutyl ketone find ethanol was coated at 32.69 cc/m$^2$ onto a polyethylene terephthalate support. When dry, the web was overcoated with a solution of 120 g of colloidal silica stabilized with ammonia (Nalco 2326) mixed with 280 g of water, 2 g of aminopropyltriethoxysilane and 0.1 g of Zonyl FSN surfactant, the mixture coated at 16 cc/m$^2$ wet laydown. The coating was dried for 3 minutes at 118° C. The coating was then exposed to a focused diode laser beam at 830 nm wavelength on an apparatus similar to that described in U.S. Pat. No. 5,446,477. The exposure level was about 600 mJ/cm$^2$, and the intensity of the beam was about 3 mW/$\mu^2$. The laser beam was modulated to produce a halftone dot image. After exposure the plate was mounted on an ABDick press and several thousand good impressions were made.

EXAMPLE 6

Example 5 was repeated but the nitrocellulose was replaced with cellulose acetate propionate and the mixture was coated at 18.88 g/m$^2$.

EXAMPLE 7

Example 6 was repeated but the cellulose acetate propionate was replaced with polyvinylacetate.

EXAMPLE 8

Example 6 was repeated but the cellulose acetate propionate was replaced with Novolak.

EXAMPLE 9

Example 6 was repeated but the cellulose acetate propionate was replaced with alpha-cyanoacrylate and the solvent was acetonitrile.

EXAMPLE 10

A mixture of 3% zirconium butoxide in propanol was stirred with slow addition of a total of 5% water, added as 10%, water in propanol. The zirconium butoxide amount was chosen so the total concentration was 1% after addition of the water in propanol. After 2 hours the mixture had a slightly hazy appearance. The mix was then coated at 21.5 cc/m$^2$ on the carbon-nitrocellulose coated support of Example 1 and dried at 118° C. for 3 minutes. The layer was then overcoated with a solution of 1.5% aminopropyl triethoxysilane in 50:50 propanol:water and dried at 118° C. for 3 minutes. The coating was then exposed to a focused diode laser beam at 830 nm wavelength on an apparatus similar to that described in U.S. Pat. No. 5,446,477. The exposure level was about 600 mJ/cm$^2$, and the intensity of the be am was about 3 mW/$\mu^2$. The laser beam was modulated to produce a halftone dot image. After exposure the plate was mounted on an ABDick press and several adequate impressions were made.

EXAMPLE 11

Example 1 was repeated but the hardener used was a mixture of dimethyl dimethoxysilane and methyl trimethoxysilane sold as Z-6070 by the Dow Corning Company. Several hundred good impressions were printed.

EXAMPLE 12

Example 11 was repeated but the hardener used was a glycidoxypropyltrimethoxysilane. Several hundred good impressions were printed.

CONTROL 1

A solution of 5% colloidal Alumina (Dispal 18N4-20) in water was coated at 21.5 cc/m$^2$ onto the same carbon-nitrocellulose coated support used in Example 1 and dried for 3 minutes at 118° C. The coating was then exposed to a focused diode laser beam at 830 nm wavelength on an apparatus similar to that described in U.S. Pat. No. 5,446,477. The exposure level was about 600 mJ/cm$^2$, and the intensity of the beam was about 3 mW/$\mu^2$. The laser beam was modulated to produce a halftone dot image. After exposure the plate was mounted on an ABDick press and impressions were made. After about 20 impressions the background began to scum. After 100 impressions the image was ugly and unusable. This shows that the crosslinker is essential for good press performance.

CONTROL 2

Example 1 was repeated in all respects except the aminopropyltriethoxysilane crosslinking agent was omitted. After exposure the plate was mounted on an ABDick press and impressions were made. The background never did go completely white, but there was a faint, low contrast image visible for a few impressions. After about 20 impressions the background was so dark that the image was essentially invisible. This control shows that the crosslinking agent is essential for good press performance.

CONTROL 3

A mixture of 1.76% titanium dioxide, 3.4% poly(vinyl alcohol) (Scientific Products, 96% hydrolyzed) 1.69% hydrolyzed tetraethylorthosilicate (prepared by stirring together for 10 minutes 22 g tetraethylorthosilicate, 44 g water, 44 g ethanol and 30 mg concentrated hydrochloric acid) 0.22% nonylphenoxypolyglycidol (surfactant) was coated at 21.5 cc/m$^2$ on the carbon-nitrocellulose coated support of Example 1 and dried at 118° C. for 3 minutes. The coating was then held at 100° C. for 1 hour. The coating was then exposed to a focused diode laser beam at 830 nm wavelength on an apparatus similar to that described in U.S. Pat. No. 5,446,477. The exposure level was about 600 mJ/cm$^2$, and the intensity of the beam was about 3 mW/$\mu^2$. The laser beam was modulated to produce a halftone dot image. After exposure the plate was mounted on an ABDick press and impressions were made. The first three or four impressions gave a light but visible image. By the tenth impression full ink density was achieved but the background had scummed to the point that the image was unrecognizable. This control shows that the process and element described in WO 94/18005 are vastly inferior to the present invention.

CONTROL 4

A mixture of 1.5% aminopropyltriethoxysilane in water was coated onto the carbon containing layer of Example 1. After drying the coating was exposed as in Example 1 and mounted on the press. The plate took ink everywhere, and no good images were printed. This shows that both the hardener and the colloidal oxide (such as silica) are needed for good printing performance.

The invention has been described in detail, with particular reference to certain preferred embodiments thereof, but it should be understood that variations and modifications can be effected within the spirit and scope of the invention.

We claim:

1. A lithographic printing plate precursor element comprising:

a) a support web, b) a coextensive ink receptive photothermal conversion layer coated on said web and c) a coextensive ink repellant layer comprising a crosslinked polymeric matrix containing a colloid of an oxide or a hydroxide of a metal selected from the group consisting of beryllium, magnesium, aluminum, silicon, gadolinium, germanium, arsenic, indium, tin, antimony, tellurium, lead, bismuth, a transition metal, and combinations thereof; wherein the ink repellent layer contains less than 5% hydrocarbon groups by weight.

2. The element of claim 1 wherein said support web is a polyester film.

3. The element of claim 1 wherein the support web is anodized aluminum.

4. The element of claim 1 wherein the photothermal conversion layer comprises radiation absorber dispersed in a binder.

5. The element of claim 4 wherein the radiation absorber is a pigment.

6. The element of claim 5 wherein the pigment is carbon.

7. The element of claim 4 wherein the radiation absorber is an IR dye.

8. The element of claim 7 wherein the IR dye is 2-{2-{2-Chloro-3-{(1,3-dihydro-1,1,3-trimethyl-2H-benz{e}indol-2-ylidene)ethylidene}-1-cyclohexen-1-yl}-ethenyl}-1,1,3-trimethyl-1H-benz{e}indolium salt of 4-methylbenzenesufonate; or 2-{2-{2-chloro-3-{(1,3-dihydro-1,1-dimethyl-3-sulfonatopropyl-2H-benz{e}indol-2-ylidene)ethylidene}-1-cylcohexen-1-yl}ethenyl}-1,1-dimethyl-3-sulfonatopropyl-1H-benz{e}indolium sodium salt.

9. The element of claim 4 wherein the binder is a celulosic binder.

10. The element of claim 4 wherein the binder is a polyvinylbutyral.

11. The element of claim 1 wherein the photothermal conversion layer comprises carbon dispersed in a cellulosic binder.

12. The element of claim 1 wherein the photothermal conversion layer comprises carbon dispersed in nitrocellulose.

13. The element of claim 1 wherein the photothermal conversion layer comprises an IR dye dispersed in a cellulosic binder.

14. The element of claim 1 wherein the photothermal conversion layer comprises carbon dispersed in a polyvinylbutyral.

15. The element of claim 14 wherein the polyvinylbutyral is poly(vinylbutyral-co-vinylalcohol-co-vinylacetate)(80%, 18%,2%).

16. The element of claim 1 wherein the ink repellent layer is a hydrophilic layer.

17. The element of claim 1 wherein the thickness of the ink repellent layer is from 0.05 to 1 $\mu$m.

18. The element of claim 1 wherein the thickness of the ink repellent layer is from 0.1 to 0.3 $\mu$m.

19. The element of claim 1 wherein the colloid is hydroxysilicon.

20. The element of claim 1 wherein the colloid is hydroxyaluminum.

21. The element of claim 1 wherein the colloid is hydroxytitanium.

22. The element of claim 1 wherein the colloid is hydroxyzirconium.

23. The element of claim 1 wherein the colloid is colloidal silica.

24. The element of claim 1 wherein the crosslinked polymeric matrix is derived from a crosslinking agent which is an alkoxy silane, an alkyl titanate, an alkyl zirconate or an alkyl aluminate.

25. The element of claim 24 wherein the crosslinking agent is a di, tri, or tetra alkoxy silane.

26. The element of claim 24 wherein the crosslinking agent is aminopropyltriethoxysilane.

27. The element of claim 24 wherein the crosslinking agent is a mixture of dimethyldimethoxysilane and methyltrimethoxysilane.

28. The element of claim 24 wherein the crosslinking agent is glycidoxypropyltrimethoxysilane.

29. The element of claim 24 wherein the crosslinking agent is tetraethylorthosilicate.

30. The element of claim 24 wherein the crosslinking agent is tetrabutyltitanate.

31. The element of claim 24 wherein the crosslinking agent is zirconium butoxide.

32. The element of claim 24 wherein the coextensive ink repellant layer contains 100 to 5000% of the colloid based on the weight of the crosslinking agent.

* * * * *